United States Patent [19]

Okigami et al.

[11] 4,424,017

[45] Jan. 3, 1984

[54] SYSTEM AND METHOD FOR BURNING LIQUEFIED GASES

[75] Inventors: Noboru Okigami; Yoshitoshi Sekiguchi, both of Maizuru; Hiroshi Hayasaka, Sapporo; Toshitsugu Koyama, Maizuru; Takeo Fujioka, Yokohama; Takeshi Yoshimitsu, Kanagawa, all of Japan

[73] Assignees: Hitachi Shipbuilding & Engineering Company Limited, Osaka; Mitsui Liquefied Gas Co., Ltd., Tokyo, both of Japan

[21] Appl. No.: 234,591

[22] Filed: Feb. 13, 1981

[51] Int. Cl.[3] ..... F23D 11/38

[52] U.S. Cl. ..... 431/3; 137/107; 222/571; 239/110; 239/113; 431/121

[58] Field of Search ..... 431/121, 3, 29, 30, 431/31, 32; 137/107, 238; 222/571; 239/106, 110, 111, 112, 113, 120

[56] References Cited

U.S. PATENT DOCUMENTS

| | | | |
|---|---|---|---|
| 2,095,242 | 10/1937 | Dick | 431/121 |
| 2,489,217 | 11/1949 | Gibson | 431/121 |
| 2,648,376 | 8/1953 | Schrader | 431/121 |
| 3,381,896 | 5/1968 | Winters | 431/121 |
| 3,408,152 | 10/1968 | Cole | 431/121 |
| 3,887,324 | 6/1975 | Reed | 431/121 |
| 3,987,810 | 10/1976 | Bjorklund | 431/121 |
| 4,265,613 | 5/1981 | Oppenberg | 431/121 |

FOREIGN PATENT DOCUMENTS

| | | | |
|---|---|---|---|
| 218466 | 1/1958 | Australia | 431/121 |
| 2477266 | 9/1981 | France | 431/121 |
| 55-131608 | 10/1980 | Japan | 431/121 |
| 55-146310 | 11/1980 | Japan | 431/121 |
| 844023 | 1/1959 | United Kingdom | 431/121 |
| 1517500 | 7/1978 | United Kingdom | 431/121 |

*Primary Examiner*—Daniel J. O'Connor
*Attorney, Agent, or Firm*—Joseph W. Farley

[57] ABSTRACT

A system for burning a liquefied gas comprises a burner gun for spraying the liquefied gas into a combustion space, a pump for feeding the gas under pressure, pipe means connecting the burner gun with the pump, and a flow regulating valve provided in the pipe means, wherein the portion of the pipe means downstream from the valve has its inner diameter so determined in relation with the flow rate of the gas that the state of the gas flow through said portion falls within fog flow zone or bubble flow zone on Baker's two-phase flow diagram.

In the system of the invention, unstable combustion of the liquefied gas due to vapor lock in the pipe means can be prevented even when the gas supply pressure is below the vapor pressure of the gas. Besides, the calorific value obtained with the system is variable over a wider range than with a conventional system. Thus the system has a remarkable industrial value.

5 Claims, 6 Drawing Figures

SYSTEM AND METHOD FOR BURNING LIQUEFIED GASES

This invention relates to a system and method for burning liquefied gases.

Generally, a liquid fuel is burnt in a burner after being forcibly fed to the burner by a pump provided in pipe means connecting a fuel tank and the burner, and the calorific value obtained with the burner is controlled by varying the degree of opening of a flow regulating valve arranged between the pump and the burner. However, in the case of a liquefied gas such as LPG or liquefied pure butane, its vapor pressure at around a room temperature is far higher, by several kilograms per square centimeter, than those of generally used liquid fuels (e.g. fuel oil). The liquefied gas therefore evaporates with increasing pressure drop in the pipe means downstream from the flow regulating valve, consequently causing unstable combustion in the burner.

Stated more concretely, a liquefied gas evaporates and permits the formation of small bubbles of vapor when the pressure in the pipe means becomes lower than the vapor pressure of the gas. These small bubbles grow into large gaseous masses while flowing through the pipe means, with the result that the liquefied gas flows through the pipe means as two-phase flow. Extreme growth of the bubbles causes the gas to flow in the pipe means as completely separated into gaseous and liquid phases, with the result that the burner receivers the gas only in gaseous phase for one period and only in liquid phase for another. Such a state of the liquefied gas flow is directly reflected on the state of combustion in a combustion space associated with the burner; that is, the combustion fluctuates with a low frequency between a small flame reflecting the combustion of the fuel supplied in gaseous phase and a large flame reflecting the combustion of the fuel supplied in liquid phase. Further, the extinction of the flame may be brought about in some cases.

"Vapor lock", as such a disturbance in supplying a fuel resulting from the separation into gaseous and liquid phases is called, causes instability or blow-off of flames. To prevent the vapor lock, it has heretofore been a common practice to limit the adjustment range of the calorific value or to operate the burning system under high pressure for keeping the pressure of the fuel from falling below its vapor pressure. Particularly the latter method is undesirable since it entails energy loss due to increase in pump driving power and fuel leakage danger due to fuel pressure rise.

In the meantime, the supply of the liquefied gas to the burner is suspended by closure of a shut-off valve provided in the pipe means between the burner and the flow regulating valve. However since the liquefied gas remains in the pipe means between the shut-off valve and the burner even after the closure of said shut-off valve, the gas in the pipe means is kept under a pressure equal to its vapor pressure (several kilograms per square centimeter), with the result that the unburnt gas flows into the burner. This is unfavorable for the maintenance of safety.

The same problem as above arises when a gaseous fuel is used. However since a liquefied gas has a larger specific gravity than the gaseous fuel, the liquefied gas flows into the burner in much larger amount. Besides since the liquefied gas goes through a process of evaporating and thereafter flowing into the burner in gaseous phase and since the temperature fall of the liquefied gas due to little heat input from the ambient air causes the gas to evaporate slowly, a problem with the liquefied gas is that the process takes a considerably long time.

A primary object of this invention, in view of the above problems, is to provide a system and method for burning a liquefied gas capable of preventing unstable combustion in the combustion space by avoiding vapor lock phenomenon in the pipe means even when the supply pressure of the liquefied gas is lower than its vapor pressure.

Another object of this invention is to provide a system for burning a liquefied gas wherein the gas, which would remain in the pipe means between the burner and the shut-off valve after urgently closing the valve to stop the fuel supply, is promptly discharged, thereby preventing possible danger.

According to one aspect of the invention, a burning system comprises a burner gun for spraying a liquefied gas into a combustion space, a pump for feeding the liquefied gas under pressure, pipe means connecting the burner gun to the pump, and a flow regulating valve provided in the pipe means, the portion of the pipe means downstream from the valve having its inner diameter so determined in relation with the flow rate of the gas through said portion that the mode of the gas flow through said portion falls within fog flow zone or bubble flow zone on Baker's two-phase flow diagram.

By setting the diameter as above, vapor lock in the pipe means can be prevented and stable combustion of the liquefied gas under a lower pressure than its vapor pressure, which has hitherto been considered impossible, becomes possible. Further it has become also possible to vary the calorific value over a wide range, as in the case of other liquid fuels, without necessitating the use of devices for producing a high pressure. Thus the industrial value of the invention is remarkably high.

According to another aspect of this invention, the system further comprises a shut-off valve provided in the pipe means between the burner gun and the flow regulating valve, purging pipe means connected to the pipe means between the shut-off valve and the burner gun, and a flare stack provided at the terminal of the purging pipe means.

According to this aspect, the fuel remaining in the pipe means between the shut-off valve and the burner gun after suspending supply of the liquefied gas is quickly discharged outside the system through the flare stack, so that there would be no danger of explosion of the remaining gas, the safety of the system thus being ensured.

Various features and effects of the invention will be understood from the description of an embodiment given with reference to the appended drawings.

Figure 1:
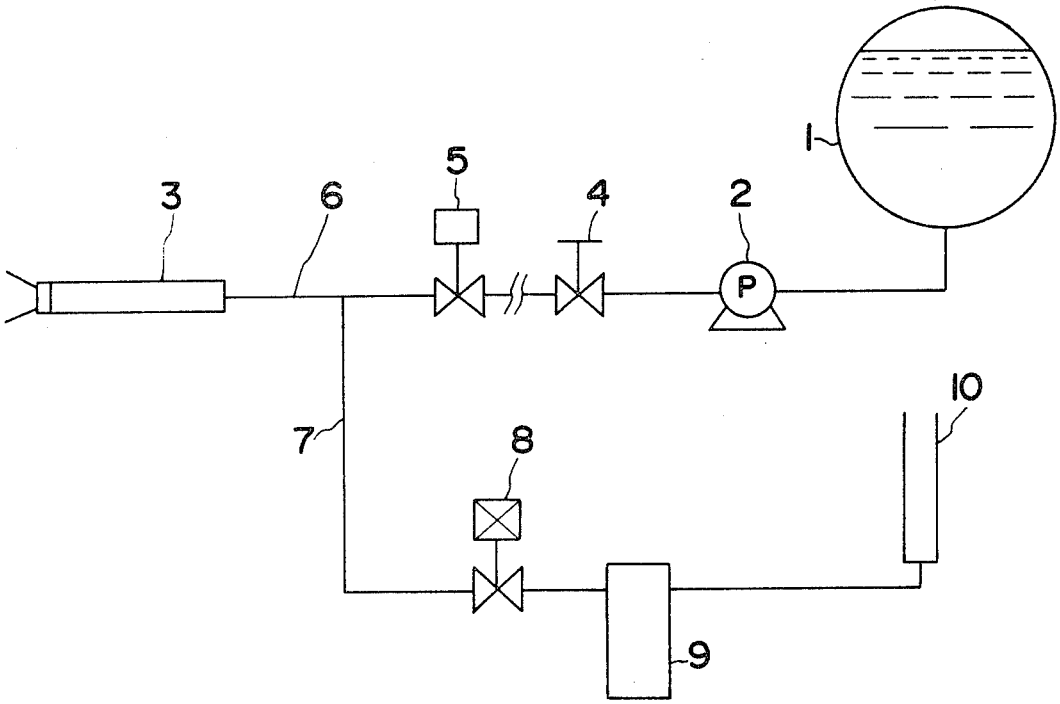
FIG. 1 is a schematic diagram showing a system for burning a liquefied gas embodying the invention.

Referring to FIG. 1 schematically showing the arrangement of a combustion system according to the invention, the reference numeral 1 designates a fuel tank for storing a liquefied gas. The liquefied gas is supplied from the tank 1 through pipe means via a pump 2, a flow regulating valve 4 and a shut-off valve 5 into a burner gun 3. The gas is thereafter sprayed into a combustion space to be burnt therein. The adjustment of the calorific value produced in the combustion space is effected by varying the degree of opening of the flow regulating valve 4 and the suspension of the gas supply is effected by closing the shut-off valve 5.

Indicated at 7 is purging pipe means connected to and arranged under the pipe means 6 between the shut-off valve 5 and the burner gun 3, and the liquefied gas remaining in the pipe means 6 after closure of the shut-off valve 5 is discharged through this purging pipe means 7.

The ratio between the opening area of the jet nozzles of the burner gun 3 and the opening area of the purging pipe means 7 is set at, for example, 1:5–30. The purging pipe means 7 is connected to a flare stack 10 through a solenoid-operated valve 8 and a fuel pot 9. The reason for arranging the purging pipe means 7 under the pipe means 6 is that the liquefied gas in liquid phase flows by its gravity into the purging pipe means 7. If the purging pipe means 7 is arranged above the pipe means 6, the intended effect is drastically reduced. On the other hand even if the pipe means 6 is long and thereby the volume of the gas to be left thereon is large, there will be no problem because the gas is temporarily stored in the fuel pot 9 disposed in the purging pipe means 7. It is to be noted here that the gas is stored in the pot 9 in liquid phase and is introduced to the flare stack 10 in vapor phase, thus preventing the gas from flowing out of the flare stack in liquid phase.

As stated before, one of the objects of the invention is to ensure stable combustion of the liquefied gas in the combustion space by preventing vapor lock phenomenon. To this end, we have examined the state of two-phase flow of the liquefied gas in the pipe means empirically and theoretically.

Figure 2:
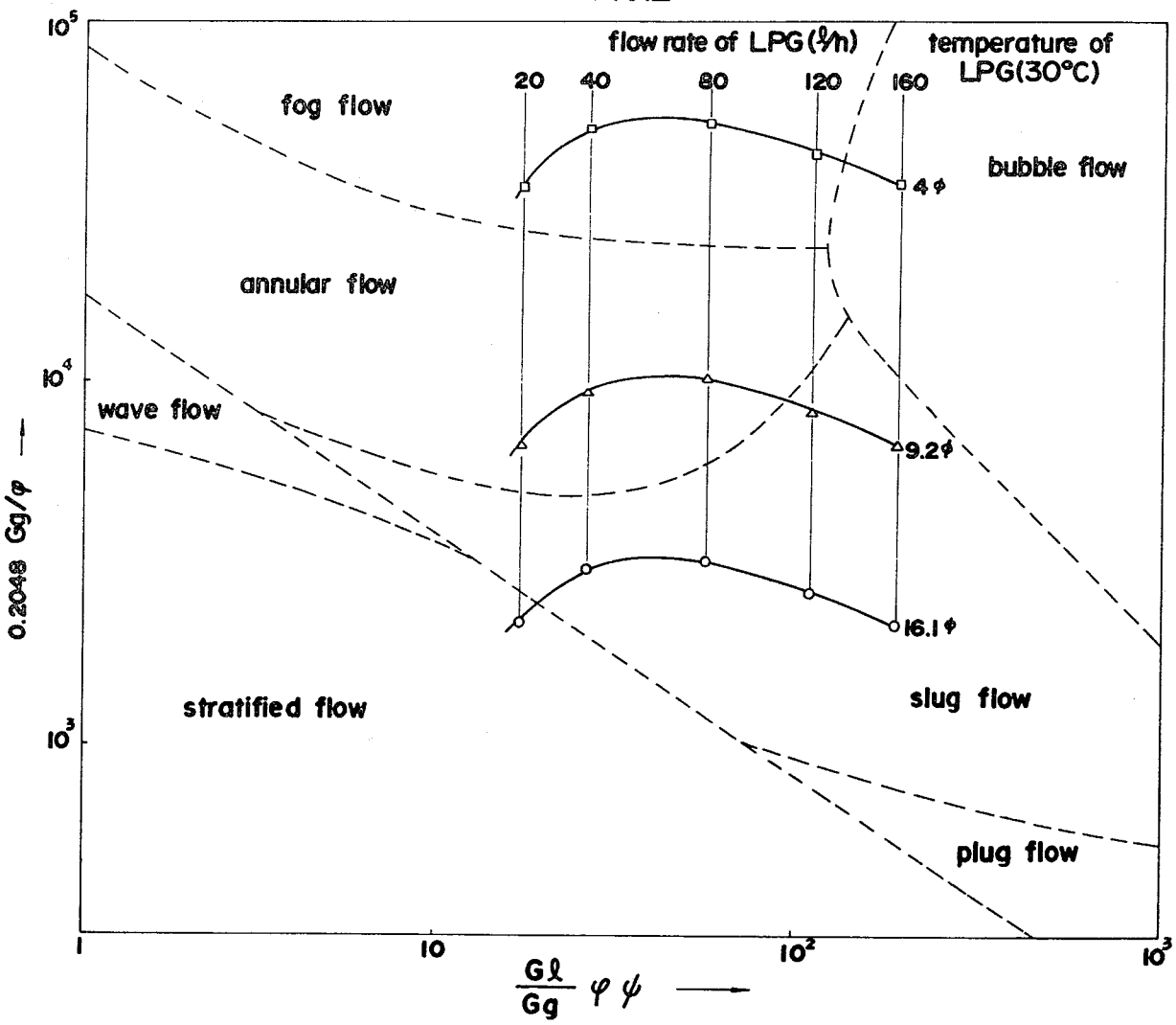
FIG. 2 is a Baker's two-phase flow diagram illustrating various modes of fuel flow with a pipe diameter taken as a parameter.

As the result of examining the state of two-phase flow of a liquefied gas (LPG) in the pipe means by referring to Baker's two-phase flow diagram ("Material for Heat Conduction Engineering", 3rd edition as amended, p. 84, published by Mechanical Engineering Society) with the flow rate of the gas taken as a parameter, it has become apparent that when the inner diameter of the pipe means is large, e.g. 16.1 or 9.2 mm, the liquefied gas flows in the pipe means as slug flow, stratified flow or annular flow in which its vapor and liquid phases are not well mixed, whereas when the diameter is small, e.g. 4 mm, it flows as bubble flow or fog flow in which its vapor and liquid phases are well mixed. From the above, it is expected and substantiated by experiment that unstable combustion in the combustion space can be prevented by making the gas to flow in the pipe means as bubble flow or fog flow. Incidentally, the coordinate system of FIG. 2 is represented by $$\left(\frac{Gl}{Gg}\phi\Psi, \frac{0.2048\ Gg}{\phi}\right),$$

where:

$\phi=[(\gamma_g/\gamma_A)(\gamma_l/\gamma_W)]^{\frac{1}{2}}$ $\Psi=(\sigma_W/\sigma_l)[(\eta_l/\eta_W)(\gamma_W/\gamma_l)^2]^{\frac{1}{3}}$ $\gamma$: specific weight (kg/m$^3$)

$\sigma$: surface tension (kg/m)

$\eta$: viscosity coefficient (kg.S/m$^2$)

G: mass velocity (kg/m$^2$h).

Suffixed characters are follows:

l: liquefied gas, liquid g: liquefied gas, vapor

A: air (normal temperature and normal pressure)

W: water (normal temperature and normal pressure).

For example, Gl represents the mass velocity of the liquefied gas in liquid phase and $\eta_A$ represents the viscosity coefficient of air at the normal temperature under the normal pressure.

Figure 3:
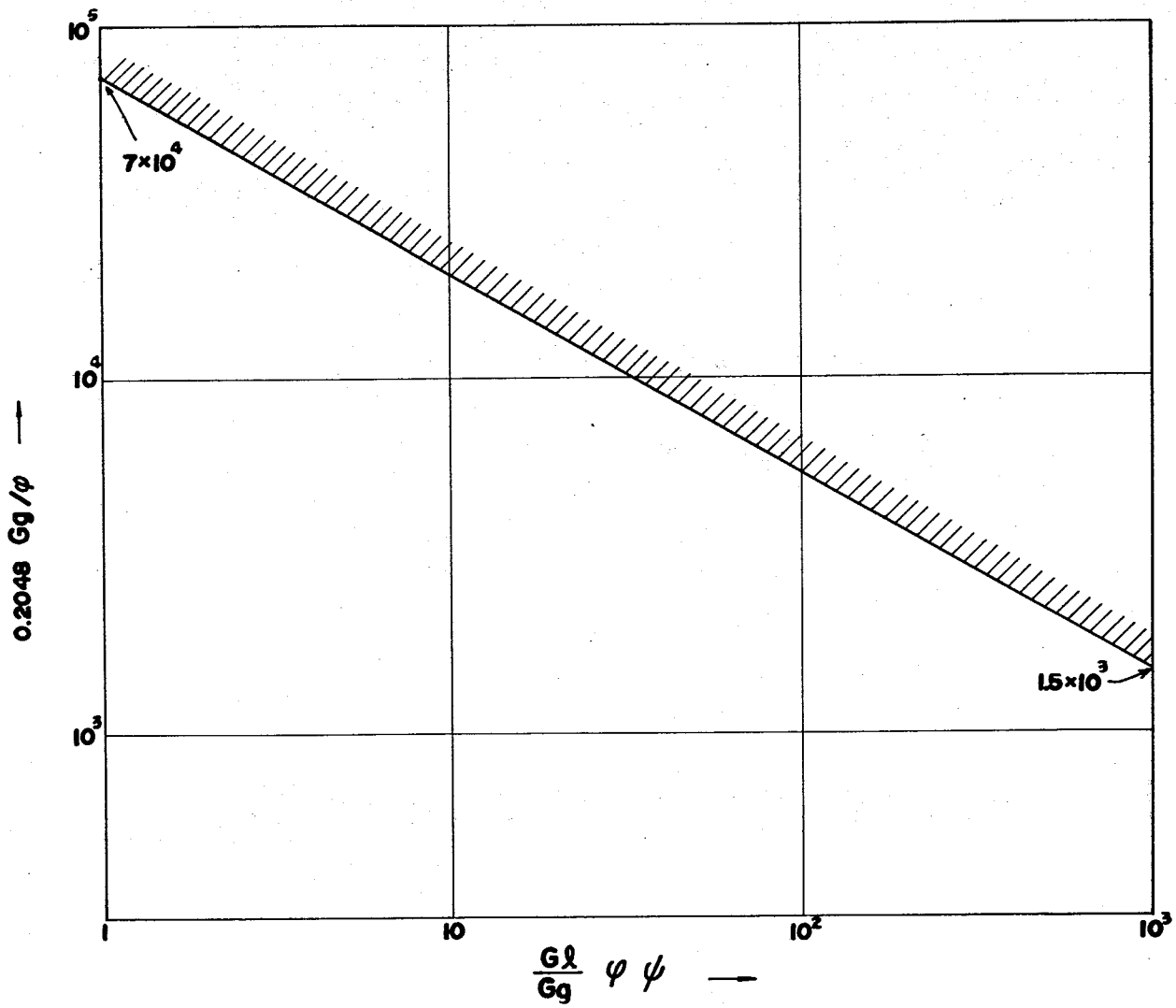
FIG. 3 is a graph using the same coordinate system as that of FIG. 2 for illustrating the subject of the invention.

In order to ensure stable combustion, it is necessary, as stated before, to make the liquefied gas to flow in the pipe means as fog flow or bubble flow. FIG. 3 illustrates this in more concrete terms. As seen, unstable combustion due to the evaporation of the liquefied gas can be avoided by so setting the inner diameter of the pipe means in relation with the flow rate of the gas that $$\left(\frac{Gl}{Gg}\phi\Psi, \frac{0.248\ Gg}{\phi}\right)$$

is located above a straight line passing through two points (1, $7\times10^4$) and ($10^3$, $1.5\times10^3$), namely a straight line represented by $$\log\left(\frac{0.2048\ Gg}{\phi}\right) = -0.5564\cdot\log\left(\frac{Gl}{Gg}\phi\Psi\right) + 4.8451,$$

in the logarithmic graph.

TABLE 1

| Composition (mol %) of Liquefied Gas (LPG) | | | | | |
|---|---|---|---|---|---|
| Ethane | Propane | Isobutane | Normal butane | Isopentane | Normal pentane |
| 0.02 | 2.42 | 37.68 | 59.26 | 0.54 | 0.08 |

In one example of the experiments carried out, when a liquefied gas of such composition (mol %) as shown in Table 1 was burnt with the supply rate thereof varied up to the maximum of 160 l/h, the inner diameter of the pipe means downstream from the valve 4 was reduced to 4 mm from a conventional diameter of 16.1 mm, with the result that the flow velocity, under the flow rate of 160 l/h, of the gas in liquid phase increased from 0.22 m/s to 3.54 m/s.

Figure 4:
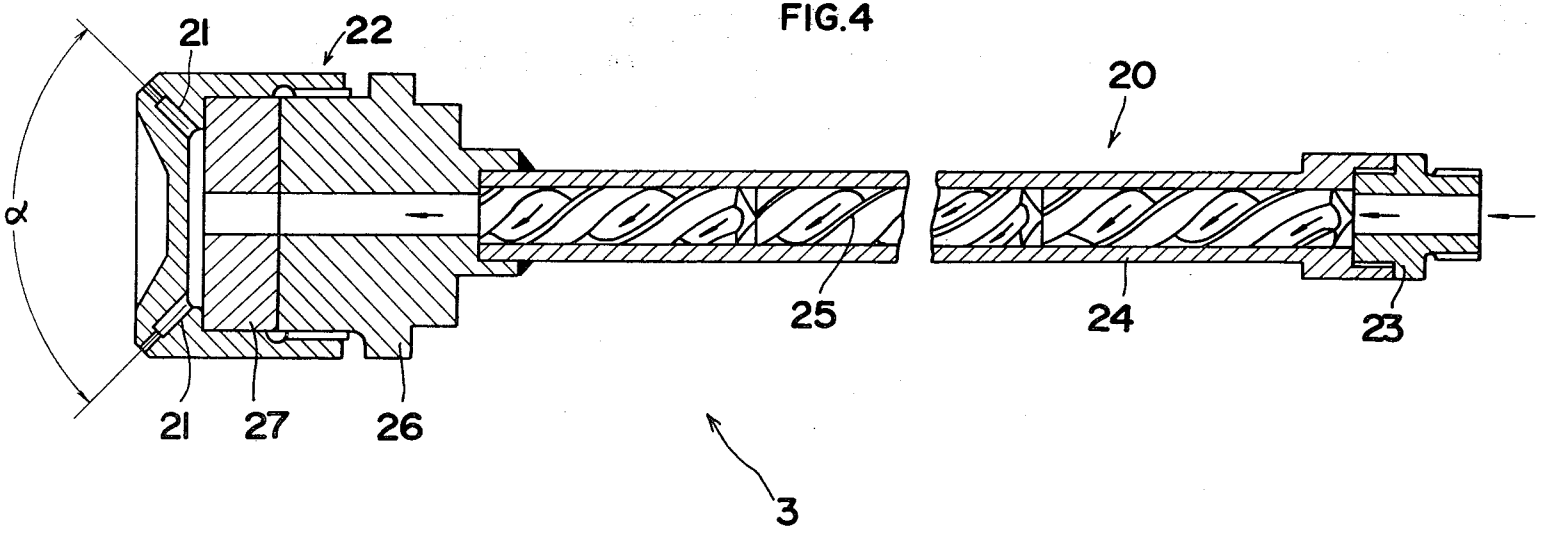
FIG. 4 is a sectional view of a burner gun used in the system of the invention.

FIG. 4 shows a burner gun used in the system according to the invention. The burner gun 3 comprises a mixer 20 for mixing the vapor and liquid phases of the liquefied gas and a burner tip 22 for spraying the liquefied gas over a wide range (angle of $\alpha$) into the combustion space through radially extending nozzles 21. The mixer 20 comprises a tubular body 24 connected to a 4 mm diam. pipe through a connector 23 and a helically twisted strip 25 provided in the inner passage of the tubular body 24. The burner tip 22 is mounted on the connector 26, with a spacer 27 interposed therebetween, which in turn is secured to the body 24.

The liquefied gas fed through from the 4 mm diam. pipe is turned into swirling flow by the mixer 20 and sprayed into the combustion space over a wide range (angle of $\alpha$) from the nozzles 21 of burner tip 22, without being distinctly separated into gaseous and liquid phases. Thus stable combustion of the liquefied gas under a pressure below the vapor pressure of the gas, which has been considered impossible, has become possible. According to the result of our experiments, when the liquefied gas is supplied with the maximum flow rate of 160 l/h, the pressure at the nozzles of the burner gun 3 is 2.4 $Kg/cm^2G$. Thus it is possible to stably burn the liquefied gas under much lower supply pressure than is conventionally possible. Further, it has become also possible to vary the flow rate of the gas (calorific value) over a wider range of 160 (l/h):20 (l/h)=8:1 (Stable combustion is possible with the flow rate of below 20 l/h).

Figure 5:
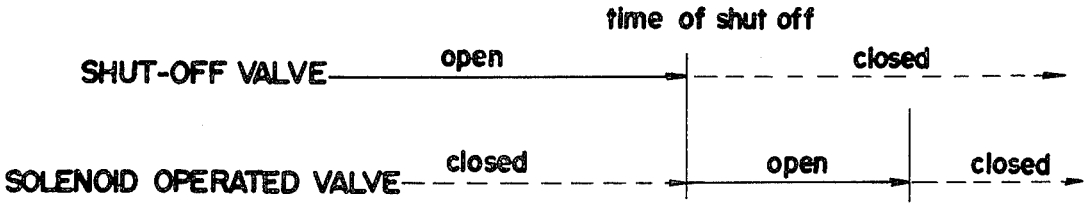
FIG. 5 is a time-chart showing the operation timing of the shut-off valve and the solenoid-operated valve for purging the remaining fuel.

Next, operation of discharging the liquefied gas which would remain in the pipe means 6 between the burner gun 3 and the shut-off valve 5 after closing the valve 5 will be described with reference to the time chart of FIG. 5.

The solenoid-operated valve 8 opens immediately upon closure of the shut-off valve 5. Thereupon almost all the remaining gas both in liquid and gaseous phases flows into the purging pipe means 7 in a short time because resistance against the inflow of the gas is much larger on the burner gun 3 side than on the purging pipe 7 side thanks to the aforementioned ratio, 1:5–30, of the total opening area of the nozzles 21 to the opening area of the pipe means 7, and because the purging pipe means 7 is arranged under the pipe means 6. The solenoid-operated valve 7 is closed after lapse of an appropriate period during which most of the liquefied gas in liquid phase flows into the purging pipe means 7. The liquefied gas introduced into the purging pipe means 7 is reserved in the fuel pot 9 and thereafter burnt in the flare stack 10 after evaporating.

Figure 6:
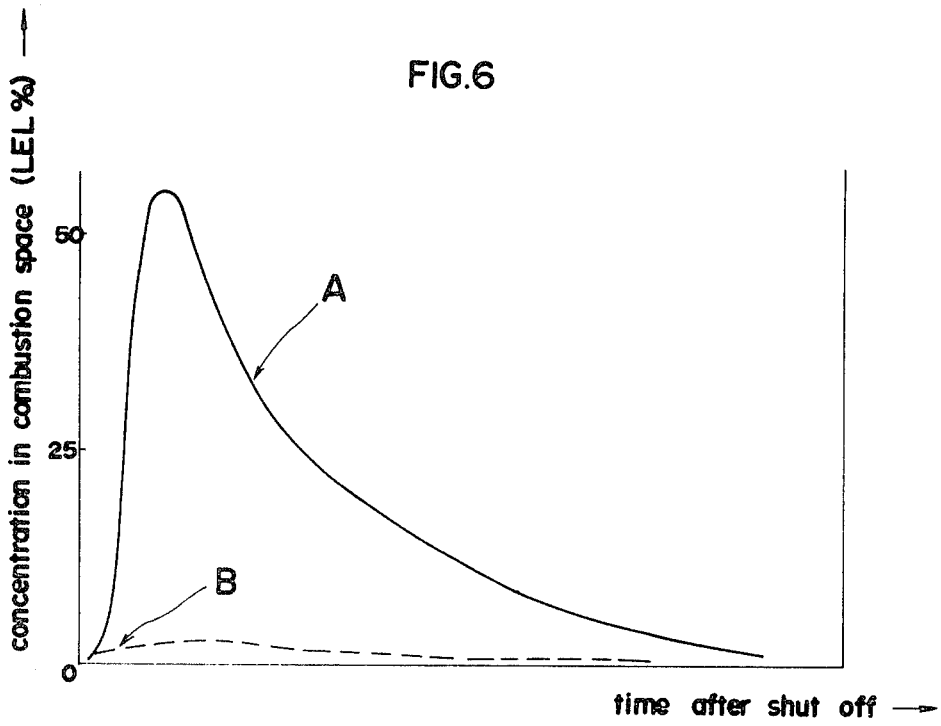
FIG. 6 is a graph showing the concentration of the liquefied gas in the combustion space.

FIG. 6 shows the concentration of the liquefied gas as determined in the combustion space near the outlet of the burner gun. In a conventional system the maximum value of the concentration after suspension of fuel supply to the burner gun, as indicated by the curve A, is 60% of LEL (Concentration of Lowest Explosion Limit). This value is relatively, though not dangeously, high. On the other hand, the maximum value is as low as 3% of LEL in the system of the invention as indicated by the curve B. Thus possible danger is completely eliminated and safety after suspension of the fuel supply is drastically enhanced.

What is claimed is:

1. A method for stably burning a liquefied gas in apparatus including a burner gun for spraying the liquefied gas into a combustion space, pump means for feeding the liquefied gas under pressure from a supply source to the burner gun through supply pipe means, a flow regulating valve disposed in the supply pipe means, and a shut-off valve disposed in the supply pipe means between the flow regulating valve and the burner gun, said method comprising:

(a) supplying the liquefied gas from said regulating valve through said supply pipe means to said burner gun and providing the portion of said supply pipe means downstream from said regulating valve with an inner diameter so determined in relation to the flow rate of said liquefied gas that said liquefied gas flows through said portion in a fog or bubble state; and, (b) purging said apparatus by positioning closable and openable purging pipe means below said supply pipe means, connecting said purging pipe means to said supply pipe means from below between said shut-off valve and said burner gun, closing said shut-off valve, opening said purging pipe means, and discharging the liquefied gas remaining in said supply pipe means between said shut-off valve and said burner gun into said purging pipe means by gravity and the vapor pressure of said remaining liquefied gas.

2. The method defined in claim 1 further comprising employing a ratio of the opening area of said purging pipe means to the discharge opening area of said burner gun of 5–30:1.

3. The method defined in claim 1 further comprising opening and closing said purging pipe means by disposing a solenoid-operated valve therein.

4. The method defined in claim 3 further comprising temporarily storing the liquefied gas discharged into said purging pipe means by providing a fuel pot therein downstream from said solenoid-operated valve.

5. The method defined in claim 4 further comprising burning the gas stored in said fuel pot by connecting a flare stack to said purging pipe means downstream from said fuel pot.

* * * * *